US011918870B2

(12) United States Patent
Bamber

(10) Patent No.: US 11,918,870 B2
(45) Date of Patent: Mar. 5, 2024

(54) GOLF CLUBS HAVING WEIGHTING SYSTEM WITH MOVABLE WEIGHTS

(71) Applicant: Jeffrey V Bamber, Cincinnati, OH (US)

(72) Inventor: Jeffrey V Bamber, Cincinnati, OH (US)

(73) Assignee: Pelican Golf, Inc., Cincinnati, OH (US)

( * ) Notice: Subject to any disclaimer, the term of this patent is extended or adjusted under 35 U.S.C. 154(b) by 0 days.

(21) Appl. No.: 17/672,587

(22) Filed: Feb. 15, 2022

(65) Prior Publication Data

US 2022/0168616 A1 Jun. 2, 2022

Related U.S. Application Data

(63) Continuation of application No. 16/920,704, filed on Jul. 4, 2020, now Pat. No. 11,266,889.

(60) Provisional application No. 62/871,129, filed on Jul. 6, 2019.

(51) Int. Cl.

| | |
|---|---|
| ***A63B 60/04*** | (2015.01) |
| ***A63B 53/04*** | (2015.01) |
| ***A63B 53/06*** | (2015.01) |
| ***A63B 53/08*** | (2015.01) |

(52) U.S. Cl.

CPC ..... *A63B 53/06* (2013.01); *A63B 53/04* (2013.01); *A63B 53/0466* (2013.01); *A63B 53/047* (2013.01); *A63B 53/065* (2013.01); *A63B 53/08* (2013.01); *A63B 60/04* (2015.10); *A63B 2053/0491* (2013.01)

(58) Field of Classification Search

CPC . A63B 60/04; A63B 2053/0491; A63B 53/06; A63B 53/04; A63B 53/0466; A63B 53/047; A63B 53/065; A63B 53/08

USPC ..... 473/324, 332, 334, 341

See application file for complete search history.

(56) References Cited

U.S. PATENT DOCUMENTS

| | | | |
|---|---|---|---|
| 2,155,830 | A | 4/1939 | Howard |
| 5,419,560 | A | 5/1995 | Bamber |
| 5,540,437 | A | 7/1996 | Bamber |
| 5,616,088 | A | 4/1997 | Aizawa et al. |
| 5,769,737 | A | 6/1998 | Holladay |
| 5,916,041 | A | 6/1999 | Antonious |
| 6,123,627 | A | 9/2000 | Antonious |
| 6,280,348 | B1 | 8/2001 | Stites |
| 6,290,609 | B1 | 9/2001 | Takeda |
| 6,379,264 | B1 | 4/2002 | Forzano |
| 6,386,990 | B1 | 5/2002 | Reyes et al. |
| 6,450,897 | B2 | 9/2002 | Stites |
| 6,554,719 | B2 | 4/2003 | Peters et al. |
| 6,702,693 | B2 | 4/2004 | Bamber |

(Continued)

FOREIGN PATENT DOCUMENTS

EP 1195350 A1 10/2002

*Primary Examiner* — John E Simms, Jr.

(57) ABSTRACT

Golf clubs having weighting systems with movable weights are disclosed. In one embodiment, the golf club head includes: a main body having a periphery; and a weighting system including a movable weight, wherein the weighting system is configured to allow the weight to move between: a first position inward of the periphery of the main body; and a second position wherein at least a portion of the weight is located outward of the periphery of the main body. In other cases, the movable weight need not be movable to a position that is outward of the periphery of the main body.

5 Claims, 5 Drawing Sheets

(56) References Cited

U.S. PATENT DOCUMENTS 7,147,573 B2 12/2006 DiMarco
7,166,040 B2 1/2007 Hoffman et al.
7,166,041 B2 1/2007 Evans
7,186,190 B1 3/2007 Beach et al.
7,201,669 B2 4/2007 Stites et al.
7,223,180 B2 5/2007 Willett et al.
7,300,361 B2 11/2007 Stites et al.
7,717,803 B2 * 5/2010 DiMarco ..... A63B 53/0466 473/335
7,815,524 B2 10/2010 Bamber
8,016,694 B2 * 9/2011 Llewellyn ..... A63B 53/04 473/335
9,358,434 B2 6/2016 Bamber
9,550,097 B1 * 1/2017 Myers ..... A63B 53/06
9,597,563 B2 3/2017 Voshall et al.
10,173,110 B1 * 1/2019 Foster ..... A63B 60/04
10,369,437 B1 * 8/2019 Cleghorn ..... A63B 53/0466
10,376,757 B2 * 8/2019 Golden ..... A63B 53/0466
10,434,385 B2 10/2019 Mine et al.
10,981,039 B1 4/2021 Ripp
11,266,889 B2 * 3/2022 Bamber ..... A63B 53/0466
2006/0122004 A1 6/2006 Chen
2006/0183568 A1 * 8/2006 Bamber ..... A63B 53/047 473/349
2006/0240907 A1 * 10/2006 Latiri ..... A63B 53/0466 473/345
2007/0004534 A1 * 1/2007 Lee ..... A63B 60/02 473/340
2007/0111820 A1 * 5/2007 Stites ..... A63B 60/02 473/350
2007/0178988 A1 * 8/2007 Tavares ..... A63B 60/02 473/340
2008/0020861 A1 * 1/2008 Adams ..... A63B 60/00 473/336
2008/0108450 A1 * 5/2008 Bamber ..... A63B 53/0487 473/341
2010/0075773 A1 * 3/2010 Casati, Jr. ..... A63B 59/00 473/519
2010/0167838 A1 7/2010 Horii
2010/0331103 A1 * 12/2010 Takahashi ..... A63B 53/0466 473/345
2013/0344976 A1 * 12/2013 Stites ..... A63B 53/047 473/335
2015/0297961 A1 * 10/2015 Voshall ..... A63B 53/06 473/335
2015/0306473 A1 * 10/2015 Breier ..... A63B 53/06 473/409
2016/0051869 A1 * 2/2016 Foster ..... A63B 53/0466 473/335
2016/0059093 A1 * 3/2016 Nielson ..... A63B 53/02 473/338
2016/0129322 A1 * 5/2016 Myers ..... A63B 53/06 473/338
2016/0129323 A1 * 5/2016 Myers ..... A63B 53/0466 473/338
2017/0001081 A1 * 1/2017 Harrington ..... B21K 17/00
2017/0173413 A1 * 6/2017 Cleghorn ..... A63B 60/02
2017/0173420 A1 * 6/2017 Frame ..... A63B 53/047
2018/0311547 A1 * 11/2018 Busch ..... A63B 53/007
2018/0326268 A1 * 11/2018 Yi ..... A63B 53/0466
2019/0009143 A1 1/2019 Myers
2021/0001191 A1 * 1/2021 Bamber ..... A63B 53/065
2021/0260449 A1 * 8/2021 Cleghorn ..... A63B 53/0466

* cited by examiner

GOLF CLUBS HAVING WEIGHTING SYSTEM WITH MOVABLE WEIGHTS

This application is a continuation of U.S. patent application Ser. No. 16/920,704 filed Jul. 4, 2020, which claims priority to U.S. Provisional Patent Application No. 62/871,129 filed Jul. 6, 2019, the entire disclosure of such applications being incorporated herein by reference.

FIELD OF THE INVENTION

The present invention relates to golf clubs, and more particularly to golf clubs having a weighting system with movable weights.

BACKGROUND OF THE INVENTION

Patents relating to golf clubs include U.S. Pat. Nos. 5,419,560; 5,540,437; 6,702,693 B2; and 7,815,524 B2, and the references listed on the face and any subsequent pages thereof.

A number of patents and patent publications are directed to golf club heads with an adjustable center of gravity. Such patents include U.S. Patent Application Publication No. 2019/0009143 A1, Myers (Callaway Golf Company). Some of these patents disclose metal wood club heads having a channel and a slidable weight assembly disposed in their soles or skirt portion. The adjustability of the moment of inertia and center of gravity of such club heads is, however, limited due to the fact that the slidable weight assembly is confined to locations within the periphery of the club head.

There remains a need for weighting mechanisms that allow for adjusting the moment of inertia and center of gravity of such club heads to an even greater degree.

SUMMARY OF THE INVENTION

The present invention relates to golf clubs, and more particularly to golf clubs having a weighting system with movable weights. This can allow the moment of inertia and center of gravity to be adjusted.

There are numerous, non-limiting embodiments of the invention. All embodiments, even if they are only described as being "embodiments" of the invention, are intended to be non-limiting (that is, there may be other embodiments in addition to these), unless they are expressly described as limiting the scope of the invention. Any of the embodiments described herein can also be combined with any other embodiments in any manner to form still other embodiments.

The golf clubs may comprise metal woods, hybrids, irons, "crossover irons", or putters. The golf clubs may comprise movable features, such as a weighting system, that have one or more weights that are movable from a first position to a second position. In some cases, the movable weight may be movable from a position inward of the periphery of the main body of the club head to a position that is outward of the periphery of the main body. In other cases, the movable weight need not be movable to a position that is outward of the periphery of the main body.

In one embodiment, the golf club head comprises:

a main body having a periphery; and a weighting system joined to said main body, said weighting system comprising a movable weight, wherein said weighting system is configured to allow the weight to move between:

a first position that is located inward of the periphery of the main body; and a second position wherein at least a portion of said weight is located outward of the periphery of said main body.

The weighting system can take several different forms. In some cases, the weighting system can comprise a track and at least one weight that is movable between different positions along the track. In some cases, the weighting system can comprise at least one weighted element that is movable from a retracted position to an extended position. In some cases, the latter type of weighted element may be biased to move in a particular direction, such as by one or more springs. In some cases, the weighting system can comprise at least one weighted element that is rotatable from a first angle to a second angle. Such a weighted element (or "rotatable weight element") may provide rotation by being pivotable.

Other embodiments are also contemplated. A shaft and a grip can be further provided to form a golf club. The shaft has two ends, where one end is inserted into the club head, or into a hosel joined to the club head. The grip can be positioned on top of the other end of the shaft.

Any of the adjustable elements described herein can be adjustable in a manner that makes the golf club legal for tournament play according to the rules of the USGA. For instance, such clubs would typically not be adjustable during a round of golf.

BRIEF DESCRIPTION OF THE DRAWINGS

While the specification concludes with claims particularly pointing out and distinctly claiming the present invention, it is believed the invention will be better understood from the following description taken in conjunction with the accompanying drawings.

DETAILED DESCRIPTION OF THE INVENTION

The present invention relates to golf clubs, and more particularly to golf clubs having a weighting system with movable weights.

Figure 1:
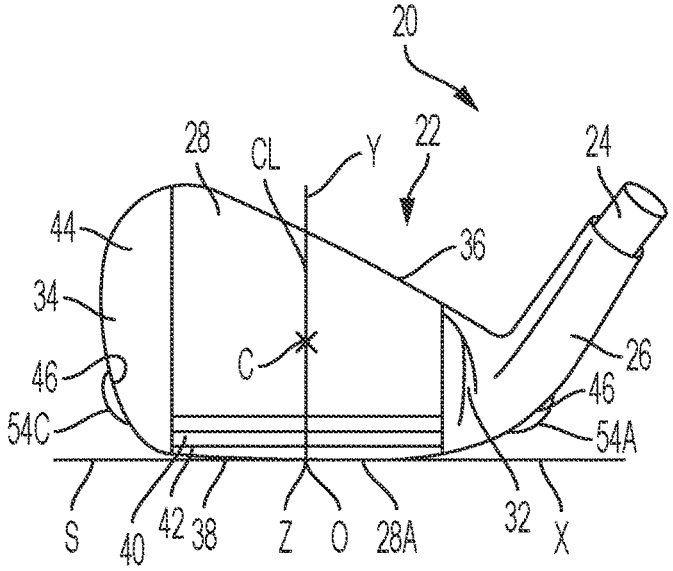
FIG. 1 is a front elevation view of one embodiment of a golf club head in a Cartesian coordinate system.

FIG. 1 shows one embodiment of the lower portion of a golf club 20. The golf club 20 comprises a club head 22 and a shall 24. The grip is conventional and is not shown. The club head 22 shown in FIG. 1 is of the "iron" type. It should be understood, however, that the weighting systems described herein are also applicable to: "wood" or "metal wood" club heads; "crossover irons" (player's irons with additional forgiveness); "hybrid" club heads which combine the features of irons and metal woods; and putters.

The club head 22 shown in FIG. 1 comprises a club face 28, a back surface 30 (shown in FIG. 3), a heel or heel portion 32, a toe or toe portion 34, a top edge 36, and a sole 38. The club face 28 has a leading edge 28A, which may have a slight convex curvature. The club face 28 has a centerline, CL, which on irons will typically pass through the middle of the grooved portion 40 of the club face. Several representative grooves 42 are shown. The club face 28 may have additional grooves 42 in the region located vertically above the representative grooves shown. The club head 22 may comprise a hosel 26 joined adjacent to the heel portion 32 into which the lower end of the shaft 24 is inserted. The hosel 26 is integrally formed with the club head in this embodiment. In other embodiments, the hosel 26 may be a separate component. In other embodiments, the hosel 26 may be optional.

Figure 1A:
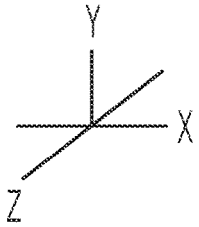
FIG. 1A is a perspective view of the Cartesian coordinate system shown in FIG. 1.

FIG. 1 shows the golf club head 22 in a Cartesian coordinate system. The Cartesian coordinate system has X, Y, and Z axes. (These axes are shown in a perspective view to the right of FIG. 1A.) For the purposes of describing the present invention, the golf club head 22 is placed with its sole 38 on a flat surface S as at address. The origin, O, of the coordinate system will be at a point on the leading edge 28A of the club face 28 that is aligned with the centerline, CL, of the club face 28.

The X axis runs tangent to the point on the leading edge 28A of the club head 22 at the origin O in a direction between the heel 32 and the toe 34. The term "X-direction" refers to a direction parallel to the X axis. The positive X direction along the X axis runs from the origin, O, toward the heel 32. The negative X direction along the X axis runs from the origin, O, toward the toe 34. The X direction may be referred to herein as the "lateral" direction. The Y axis is perpendicular to the X axis and intersects the X axis. The Y axis runs from the origin O where it intersects the X axis in a direction vertically upward from the origin O. The Y axis can define positions (in the "Y-direction") that are disposed above the bottom of the sole 38 of the club head 22. The Y direction refers to a direction parallel to the Y axis, and may be referred to herein as the "vertical" direction. The third axis, the Z axis, passes through the origin O, and is perpendicular to X and Y axes (and goes into the plane of the paper). The Z axis can define positions (in the "Z-direction") that are either on the club face 28, or in front of the club face, or to the rear of the club face 28. The Z direction refers to a direction parallel to the Z axis, and may be referred to as the forward or rearward (or front or rear) direction. The X and Z axes define an X-Z plane that contains surface S.

Figure 3:
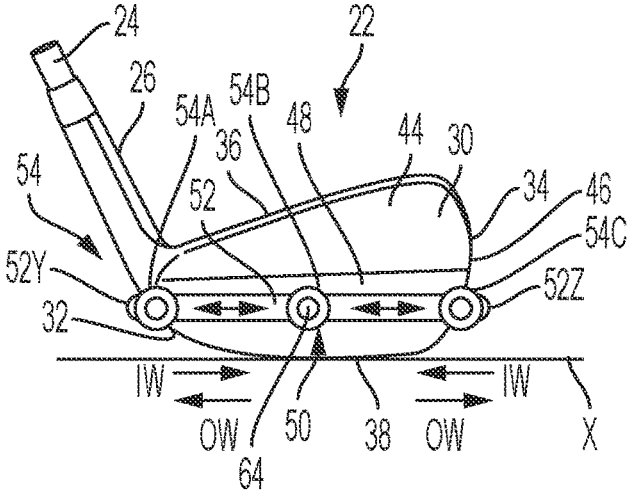
FIG. 3 is a rear elevation view of one embodiment of the golf club head shown in FIG. 1.

The terms "inward" ("inside" or "inboard") IW and "outward" ("outside" or "outboard") OW may be used herein to define the relative positions of various elements on the club head 22. These directions may be shown with arrows in the drawings. For example, as shown in FIG. 3, if a first element is described as being "laterally inward" of a second element, it is meant that the first element is closer to the center of the club head 22 (that is, the centerline CL) in the X direction than the second element. If a first element is described as being "laterally outward" of a second element, it is meant that the first element is spaced further away from the center of the club head 22 in the X direction than the second element.

The center of gravity (and other properties) of the club head are defined in the conventional manner which is further described in the book entitled "Golf Club Fitting & Performance" by Ralph Maltby, The GolfWorks, Newark, Ohio, U.S.A., 2011. The club head 22 can be balanced on its face, its sole, or other surfaces of the club head. The club head has a center of gravity CG that is located within the periphery of the club head 22 where lines drawn through all the balance points intersect. The center of gravity CG of the club head 22 can be: above; at; or, below the center of gravity of a golf ball when the golf club is at address position behind the golf ball. (A center of gravity that is above the center of gravity of a golf ball, however, may be less desirable, and in some cases, undesirable.) The moment of inertia. MOI, of a golf club head can be calculated, or it may be measured using a testing machine at The GolfWorks, Newark, Ohio.

Certain types of golf clubs are commonly used (at least part of the time) to hit golf balls at rest on the ground (rather than being teed up on a golf tee as with drivers). These include irons, crossover irons, fairway woods, hybrids, and the like. In the case of these types of clubs, it may be desirable for the golf club head to have a vertical center of gravity that is less than or equal to the center of gravity of a golf ball at rest on the ground. The term "vertical center of gravity" refers to the vertical (Y direction) distance that the center of gravity is from the sole 38 of the club head 22. Thus, the golf club head's vertical center of gravity may be at or below the center of gravity of a golf ball at rest on the ground. Since a golf ball has a diameter of 1.680 inches (42.67 mm), it may be desirable for these types of golf clubs to have a vertical center of gravity that is less than or equal to 0.84 inches.

The club head 22 comprises a main body 44 and a weighting system. The term "main body", as used herein, refers to the portion of the club head 22 that does not include the weighting system. The main body 44 has a periphery 46. The periphery 46 of the main body 44 may comprise portions on the club face 28, the back surface 30, the heel portion 32, the toe portion 34, the top edge 36, and the sole 38 of the club head 22. In some cases, the main body can be at least partially hollow for any suitable purpose, such as to allow for the elimination of weight and/or redistribution of weight (such as by the weighting systems described herein).

The main body 44 of the club head 22 can comprise one or more materials. The main body 44 of the club head 22 can be made of any suitable material or materials. Suitable materials include, but are not limited to stainless steel, titanium, graphite, carbon fiber, aluminum, polymeric material, plastic, or combinations thereof. The main body 44 of the club head 22 can be made in any suitable manner including, but not limited to forging, casting, molding, or joining one or more forged, cast, molded, or otherwise formed, pieces together in any suitable manner. Suitable manners for joining such pieces together include, but are not limited to using mechanical fasteners, adhesives, brazing, welds, friction fitting, or any other known manners of attachment.

Figure 4:
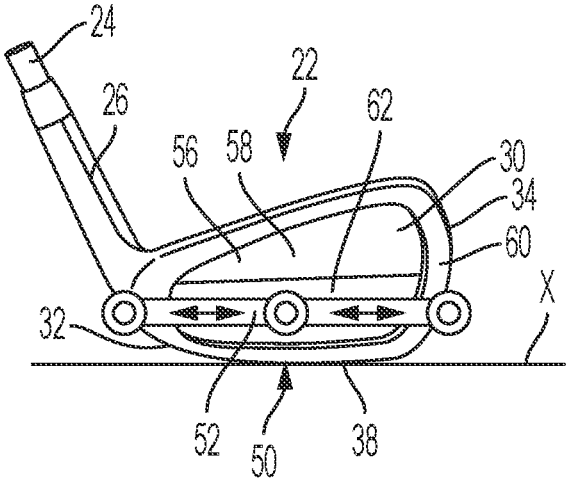
FIG. 4 is a rear elevation view of another embodiment of a golf club head which has a weighted perimeter portion.

The golf club head 22 shown in FIG. 3 is of a "blade" type and has a thicker lower portion 48 on its back surface 30. FIG. 4 shows that in other cases, the club head 22 may be a cavity back perimeter weighted club head. Metal woods, crossover irons, and hybrid clubs also may, but need not, be perimeter weighted. If these types of clubs are perimeter weighted, they may, but need not, have a cavity in their back surface.

Figure 2:
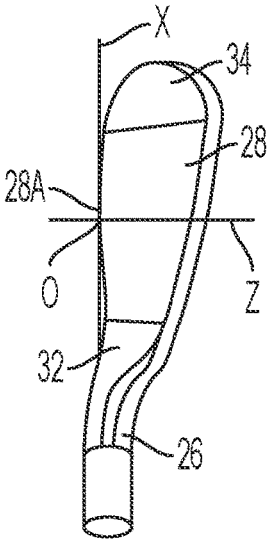
FIG. 2 is a top view of the golf club head shown in FIG. 1.

The club head 22 shown in FIGS. 1-3 comprises a weighting system (or "movable weighting system") 50 that is joined to the main body 44 of the club head 22 in a particular location. The weighting system 50 can be joined to any suitable portion of the main body 44 of the club head including one or more of: the hosel 26, the back surface 30, the heel portion 32, the toe portion 34, the top edge 36, the sole 38, and the crown and/or the skirt portion in the case of metal woods and the like.

The weighting system 50, in the embodiment shown in FIGS. 1-3, comprises a track weighting system (or "track system") comprising a track 52 and at least one movable weight 54. At least a portion of the track 52 may comprise a channel. The track 52 (in any of the embodiments described herein) can be rectilinear, curvilinear, or comprise some segments that are rectilinear and some segments that are curvilinear. The movable weight(s) 54 may be slidable on the track and in the channel. The weight(s) are designated generally by reference number 54. The club head 22 in any of the embodiments described herein can have any suitable number of weights 54. Suitable numbers of weights 54 include, but are not limited to: 1, 2, 3, 4, 5, 6, 7, 8, . . . , etc. If there is more than one weight, they may be designated as 54A, 54B, 54C, etc. It should be understood that only the weight(s) 54 of the weighting system 50 need be movable. One or more portions of the weighting system (such as a track 52) may not be movable (that is, the track and other portions may be fixed).

In FIGS. 1-3, the weighting system 50 is joined to the back 30 of the club head 22. The term "joined", as used herein, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined" includes both those configurations in which an element is temporarily joined to another element, or in which an element is permanently joined to another element.

In the embodiment shown in FIG. 3, the track 52 may be formed as part of the thicker lower portion 48 on the back surface 30 of the club head 22, or it may comprise one or more pieces of material having a channel therein that are joined to the thicker lower portion 48. The pieces of material, if present, can be made of any suitable material, including any of the materials described herein as being suitable for the main body of the club head 22. In cases in which there is no thicker lower portion 48 on the back surface 30 of the club head 22, the track 52 may be joined to a suitable position on the back surface 30 of the club head 22. As discussed above, the track 52 can define a path for the weights 54 that is rectilinear, curvilinear, or it can comprise some portions that are rectilinear and some portions that are curvilinear.

The track 52 may, in some cases, be oriented generally horizontally on the back surface 30 of the club head 22 so that the weight(s) 54 are movable in the X direction. The track 52 may extend between the heel 32 of the club head and the toe 34 of the club head 22. In some cases, the track 52 may be configured so that it terminates laterally inward of the portions on the periphery 46 of the club head at the heel 32 and/or the toe 34. In other cases, the track 52 may extend to one or more of the portions on the periphery 46 of the club head at the heel 32 and/or the toe 34, or beyond the same. In some cases, the track 52 may be configured so that at least a portion of the weight 54, (and in some cases, all of the weight 54) extends laterally outward beyond the heel and/or toe of the club head. FIG. 3 shows an example of a track 52 that comprises extensions 52Y and 52Z that extend beyond the heel 32 and toe 34, respectively, of the club head 22. Such extensions 52Y and 52Z can be of a length that allows some or all of the weight 54 to extend laterally outward beyond the heel and/or toe of the club head.

The weights 54 are comprised of a material (or more than one different material) of higher specific gravity than at least a portion of the main body 44 of the club head 22. The phrase "higher specific gravity", as used herein, means higher specific gravity than at least some portion of the main body 44 of the club head 22. The weights 54 may have a higher specific gravity than the portion(s) of the main body of the club head 22 with the highest specific gravity. In other embodiments, the weights 54 may have a higher specific gravity than at least some other portion of the main body 44 of the club head 22. Non-limiting examples of materials with higher specific gravity include: lead, brass, and tungsten. Such materials would have a higher specific gravity than stainless steel or titanium, for example, which may form at least a portion of the main body 44 of the club head 22.

The weights 54 described herein refer to higher specific gravity material that is supplied by the manufacturer either as part of the club head 22, or together with, or for the club head 22 as a component for the club head 22 which is intended to be added to the club head 22. That is, the weights 54 described herein are those that are intended to be offered for use as part of the club head, as manufactured. The weights 54 referred to herein are intended to be distinguished from higher specific gravity material, such as lead tape, which may be obtained and subsequently cut and applied to the club head by a golfer, but is not a part of a pre-fabricated weighting system for a particular club head.

The weights 54 can be of any suitable configuration and size. It is not necessary that all of the weights 54 have the same configuration, or be of the same size. If there is more than one weight 54, any two or more weights 54 may differ in configuration and/or size.

The weights 54 may have a regular-shaped, or an irregularly shaped configuration. The weights 54 may also comprise structures that have one or more regularly shaped sides and one or more irregularly shaped sides. The weights 54 may be symmetrical, or asymmetrical about one or more axis. The weights 54 can have sides or portions with rectilinear shapes, curvilinear shapes, or they can comprise portions having both types of shapes. The aforementioned shapes can be seen when the weights 54 are viewed from a given direction (including, but not limited to the back surface 30 of the club head 22). Examples of regular shaped configurations include, but are not limited to: cubes, parallelepipeds, any other known polygon shapes, spheres, hemispheres, cylinders, and certain other geometric shapes. In some embodiments, however, it may be desirable for the weights 54 to exclude certain of these configurations (e.g., spherical or cylindrical).

In the embodiment shown in FIG. 3, the weights 54 may have a generally cylindrical configuration, or alternatively, a ring-shaped configuration with a central opening that fits around a slider 64 that moves along the track 52. The sliders 64 may be made of the same material as the weights 54, or of a different material, such as a lighter, lower coefficient of friction material. Alternatively, the weights 54 can be configured similarly to a combination of the weight and slider, wherein a portion of the weight comprises a stem that replaces the slider and slides within the track 52.

The weights 54 can have any suitable dimensions (e.g., length, width, diameter, or thickness). The weights 54 can have any suitable dimensions relative to the adjacent portion (or portions) of the main body 44. As used herein in reference to the weights 54, the terms "length", L, and "width", W, refer generally to the longer and shorter dimensions of the weights, respectively, as measured along the surface to which they are joined or positioned (e.g., the back surface, or the sole of the club head). If the weights do not have longer and shorter dimensions (e.g., the weights are square or circular), their length and width may be the same. The thickness of the weights 54 is their dimension measured in the direction perpendicular to the surface of the club head 22 to which the weights are joined. Thus, if the weights 54 are joined to the back surface 30 of the club head 22, the thickness will be measured in a direction from the front of the club head 22 to the back 30 of the club head 22 (that is, in the Z direction). If the weights 54 are joined to the sole 38 of the club head 22, the thickness of the weights 54 will be measured in a direction perpendicular to the portion of the sole 38 (that is, generally in the Y direction).

FIG. 4 shows an alternative embodiment of the club head shown in FIGS. 1-3. The club head 22 shown in FIG. 4 is a cavity back perimeter weighted club head. In such a case, the back surface 30 of the club head may have a central region 56 with a cavity 58 therein, wherein the club head has a first thickness measured between the club face and the back surface of the club head. The cavity 58 may be at least partially surrounded by thicker perimeter weighted portions 60 extending rearward on the back surface 30 of the club head 22 that provide the club head 22 with increased weight around at least part of its perimeter. The perimeter weighted portions 60 may include perimeter weighted portions along the heel 32, the toe 34, the top edge 36, and the sole 38 of the club head. In one version of such an embodiment, the back surface 30 of the club head 22 can be provided with a track system 52, or some other element, that forms a bridge 62 across the cavity 58, and the weight(s) 54 can be movable along this bridge 62.

Figure 5:
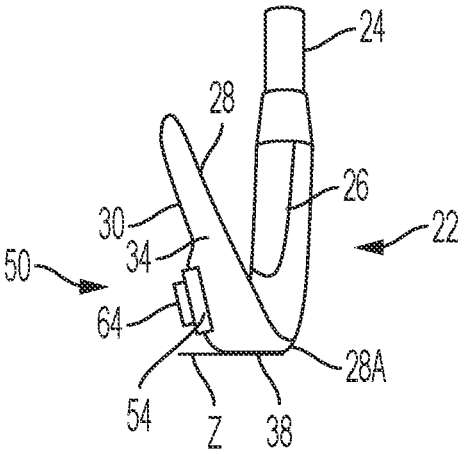
FIG. 5 is an end view of an embodiment of an iron golf club head.

FIG. 5 is an end view of an iron club head 22 that can be similar to the club head shown in either FIGS. 1-3 or FIG. 4. FIG. 5 shows that the weight(s) 54 may extend rearward in the Z direction from the back surface 30 of the club head.

Figure 6:
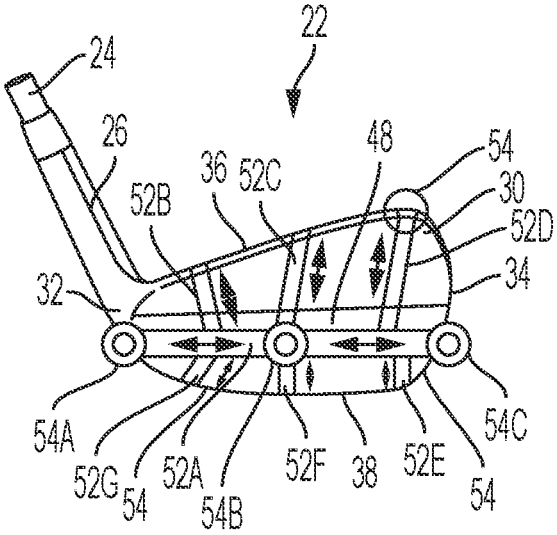
FIG. 6 is a rear elevation view of an alternative variation of the golf club head shown in FIG. 3.

FIG. 6 shows that in other cases, the weighting system 50 can comprise a plurality of track portions (such as 52A to 52G). The track portions may extend in any suitable direction. For example, a first track portion 52A for the slidable weights may extend toward, or to the heel 32 of the club head and toward, or to the toe 34 of the club head 22 (and optionally beyond the heel and/or toe). The other track portions can extend in other directions, and may be referred to as second, third, fourth, etc. track portions. The other track portions may (optionally) be connected (or "joined") to any of the other track portions such as the first track portion 52A so that a weight can be moved (e.g., by sliding) between any connected track portions. Some of the track portions may extend vertically, or substantially vertically, upward or downward (that is, in the Y direction) from track portion 52A. Such track portions including track portions 52B, 52C, and 52D may extend toward, to, or beyond the top edge 36 of the club head 22. Other track portions including track portions 52E, 52F, and 52G may extend toward or to the sole 38 of the club head 22.

In addition, as shown in FIG. 6, some of the track portions may extend toward, to, or beyond the corners of the club head, such as: (1) track portion 52B that extends toward, to, or beyond the corner where the heel portion 32 merges into the top edge 36; (2) track portion 52D that extends toward, to, or beyond the corner where the top edge 36 merges into the toe portion 34; (3) track portion 52E that extends toward, to, or beyond the corner where the toe portion 34 merges into the sole 38; and, (4) track portion 52G that extends toward, to, or beyond the corner where the heel portion 32 merges into the sole 38.

When the embodiments of the weighting system 50 are described herein as comprising a plurality of track portions, any suitable number of track portions greater than or equal to two may be present. The weighting system 50 on a club head also need not have all the track portions shown in a particular drawing figure. In some cases, the weighting system 50 may comprise any two, or more, of the track portions shown in the drawings. In other cases, the track portions can be in other configurations that are not specifically shown in the drawings but are within the scope of the subject matter disclosed herein. For instance, the track portions can be oriented in any suitable orientation that is consistent with the present disclosure. In addition, it should be understood that any of the individual track portions shown and/or described herein can be provided on a club head as the sole track, without providing any of the other track portions that are shown in a particular drawing figure (of an embodiment with a plurality of track portions).

Figure 7:
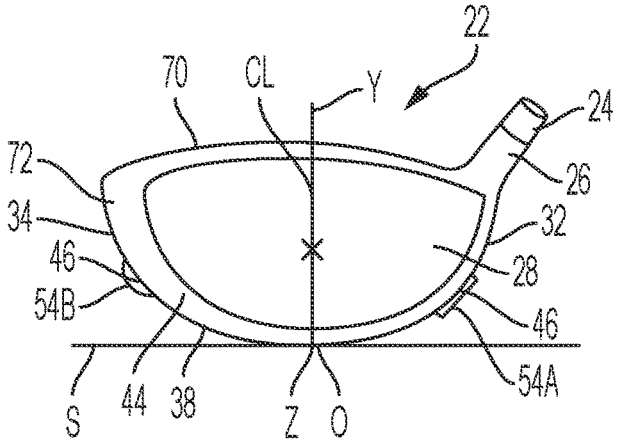
FIG. 7 is a front elevation view of one embodiment of a metal wood golf club head.
Figure 7A:
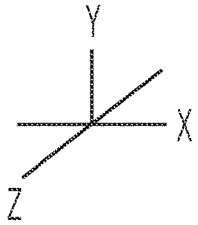
FIG. 7A is a perspective view of the Cartesian coordinate system shown in FIG. 7.
Figure 8:
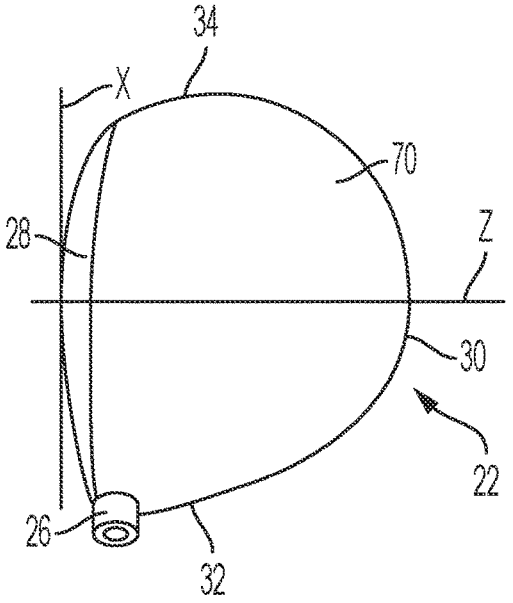
FIG. 8 is a top view of the metal wood golf club head shown in FIG. 7.
Figure 9:
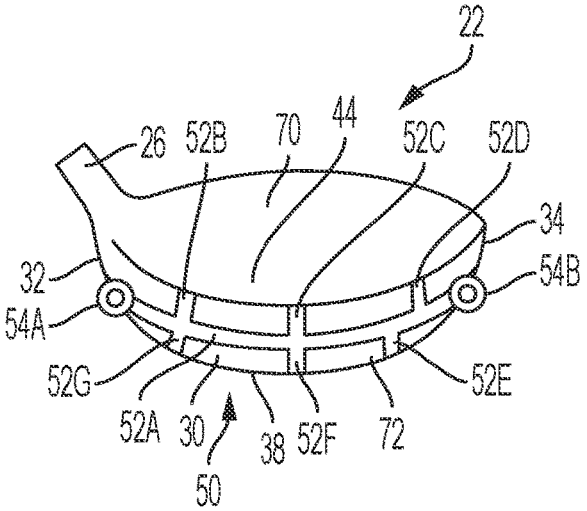
FIG. 9 is a rear elevation view of one variation of the metal wood golf club head shown in FIG. 7.

FIGS. 7-9 show one example of a track weighting system 50 with movable weights provided on a metal wood, such as a driver. The metal wood club head 22 may also comprise a crown 70 and a skirt (or skirt portion) 72 around its sides and back surface. The weighting system 50 can have any of the features and properties described above in conjunction with the irons.

For example, FIG. 9 shows that the weighting system 50 can comprise a plurality of track portions (such as 52A to 52G). The track portions may extend in any suitable direction. For example, a first track portion 52A for the slidable weights may extend toward, or to the heel 32 of the club head 22 and toward, or to the toe 34 of the club head 22 (and optionally beyond the heel and/or toe). Other track portions may (optionally) be connected (or "joined") to track portion 52A and extend in other directions so that a weight can be moved (e.g., by sliding) between any connected track portions. For example, some track portions may extend vertically, or substantially vertically, upward or downward (that is, in the Y direction) from track portion 52A. Such track portions including track portions 52B, 52C, and 52D may extend toward, to, or beyond the top edge 36 of the club head 22. Other track portions including track portions 52E, 52F, and 52G may extend toward or to the sole 38 of the club head 22.

The first track portion 52A may extend toward, to, or beyond, the heel 32 of the club head and toward, to, or beyond the toe 34 of the club head 22. For example, as shown in FIG. 9, the track portion 52A may be configured so that at least a portion of the weight 54, (and in some cases, all of the weight 54) extends laterally outward beyond the heel 32 and/or toe 34 of the club head. The feature of FIG. 3 where the track 52 comprises extensions 52Y and 52Z that extend beyond the heel 32 and toe 34, respectively, of the club head 22 can also be applied to the club head 22 shown in FIG. 9. Such extensions 52Y and 52Z can be of a length that allows some or all of the weight 54 to extend laterally outward beyond the heel and/or toe of the club head.

Figure 10:
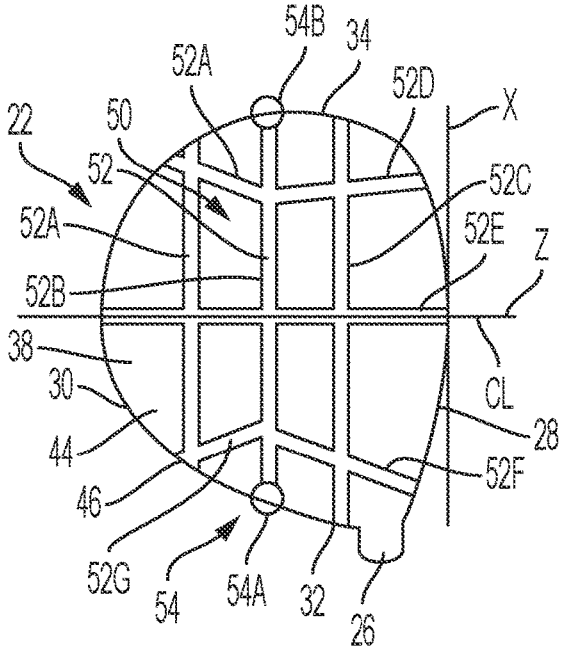
FIG. 10 is a bottom view of a metal wood having an alternative type of weighting system.

FIG. 10 shows a track weighting system 50 that is joined to sole 38 of the main body 44 of a metal wood, such as a driver or fairway metal wood. The track weighting system 50 can be provided in one or more recesses in the sole 38 of the club head so that it does not interfere with placing the club on the ground. FIG. 10 shows that the weighting system 50 on the sole 38 of the club head 22 can comprise a plurality of track portions (such as 52A to 52H similar to the embodiments shown in FIGS. 6 and 9. The track portions may (optionally) be connected (or "joined") so that a weight 54 can be moved (e.g., by sliding) between any connected track portions.

The track portions on the sole 38 may be oriented in any suitable direction. The track portions can be oriented in the X direction, the Z direction, or any direction in the X-Z plane. The different track portions can be parallel to each other, or they can form an angle or other suitable relationship with one another. In the embodiment shown in FIG. 10, the track portions can form a grid on the sole 38 of the club head to allow a high degree of flexibility in locating the weight(s) 54.

As shown in FIG. 10, some track portions, such as 52A, 52B, and 52C may extend in the X direction and be generally parallel. The track portions 52A, 52B, and 52C may extend toward, to, or beyond, the heel 32 of the club head and toward, to, or beyond the toe 34 of the club head 22. For example, as shown in FIG. 10, the track portion 52B may be configured so that at least a portion of the weight 54, (and in some cases, all of the weight 54) extends laterally outward beyond the heel and/or toe of the club head. The feature of FIG. 3 where the track 52 comprises extensions 52Y and 52Z that extend beyond the heel 32 and toe 34, respectively, of the club head 22 can also be applied to the club head 22 shown in FIG. 10. Such extensions 52Y and 52Z can be of a length that allows some or all of the weight(s) 54 to extend laterally outward beyond the heel and/or toe of the club head.

FIG. 10 shows that track portion 52E is oriented in the Z direction and is disposed along the centerline of the club head 22. Track portions 52D, 52F, 52G, and 52H may be perpendicular to track portion 52E. Alternatively, as shown in FIG. 10, one or more of track portions 52D, 52F, 52G, and 52H may be generally oriented in the Z direction, but form an angle with track portion 52E.

Figure 11:
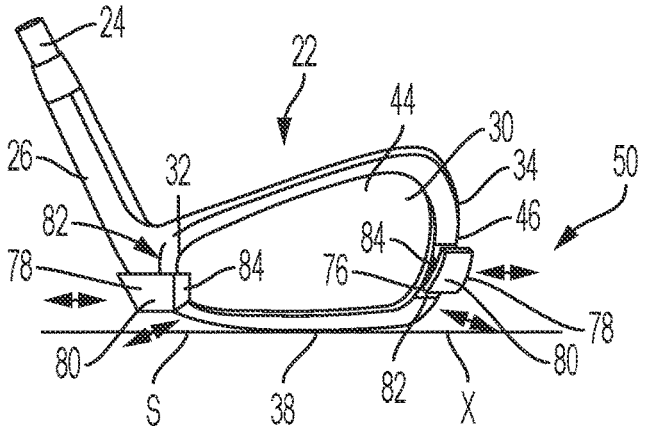
FIG. 11 is a rear elevation view of an iron golf club head having an alternative type of weighting system.
Figure 12:
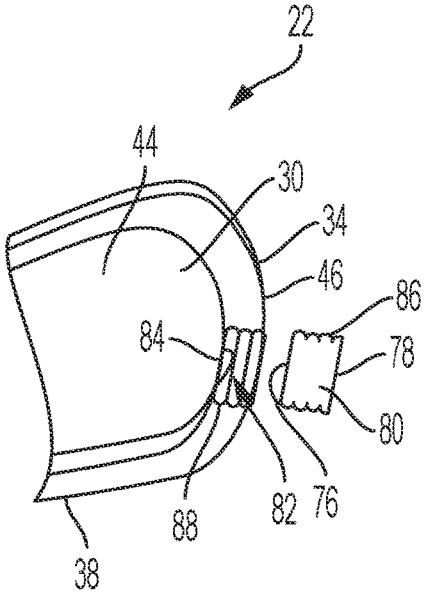
FIG. 12 is an enlarged, partially fragmented rear elevation view showing a portion of a variation of the golf club head shown in FIG. 11.

FIGS. 11 and 12 show examples of an alternative weighting system that comprises at least one weight element (or weight) 80 that may be, at least initially, at least partially located in a recess 82 in a portion of the periphery 46 of the main body 44. The weight(s) 80 may, in certain embodiments, be sized and configured to fit into a mating recess in one or more particular regions of the main body 44 of the club head 22. The club head 22 can have any suitable number of weight elements 80 located in recesses 82. The recesses 82 and weight elements 80 can be in any portion of the club head 22. G The weight element(s) 80 may be movable from a retracted position inside the recess 82 to one or more extended positions. That is, in the retracted position, the weights are located at least partially in the recess. In the extended position, the weight element(s) 80 further protrude from the recess 82. In some cases, this weight element 80 may be movable outward from the heel 32 and/or toe 34 in the X direction as shown by the upper set of double-headed arrows in FIG. 11. Alternatively, one or more of these weight elements 80 may be inserted into recesses that are oriented at an angle to the X direction, such as a slight downwardly oriented angle, as shown by the lower set of double-headed arrows in FIG. 11. The weight elements 80 may be biased to move in a particular direction, such as by one or more springs 84. The spring 84 may have a first portion (or first end) thereof adjacent to the surface of the main body 44 that defines the recess 82, and a second portion (or second end) thereof which is adjacent to the inner surface of the weight element 80. The first portion of the spring 84 may be joined to the surface of the main body 44 that defines the recess 82, and/or the second portion of the spring 84 may be joined to the inner surface of the weight element 80.

FIG. 12 shows that the weight element 80 and the recess 82 can be provided with one or more pre-established positions for the weight elements 80 with respect to the periphery 46 of the club head. As shown in FIG. 12, these locations can be created by providing the one or more of the surface defining the recess 82 and a portion of the surface of the weight element 80 with engageable features, such as 86 and 88. These engageable features 86 and 88 on at least one of the weight elements 80 and the surface that defines the recess 82 may comprise a flexible material that is joined thereto to allow the weight element 80 to move between positions.

The weight elements 80 have an inner surface 76 and an outer surface 78. The outer surface 78 of the weight element shown in FIGS. 11 and 12 can have any suitable configuration. In some cases, at least some of the weight elements 80 can have an exterior configuration that forms a part of, or is a continuation of, the curvature of the periphery 46 of the main body 44 of the club head 22. In other embodiments, at least some of the weight elements 80 may create a discontinuity or change in the curvature of the periphery 46 of the main body 44 of the club head 22. Non-limiting, examples of discontinuities in the curvature of the periphery 46 of the main body 44 are breaks in the curvature, or changes in the direction of the curvature (e.g., a change from a convex curved surface to a concave curved surface or a planar surface). The description of the configuration of the weight elements 80 in this paragraph can also apply to the weights 54 in any of the previous embodiments.

Figure 13:
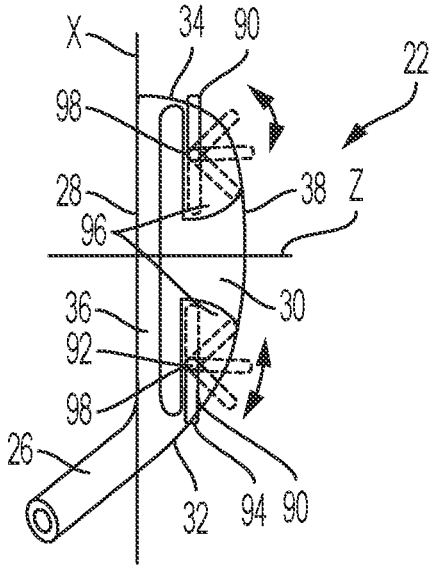
FIG. 13 is a perspective view of an iron golf club head looking down the clubface, where the club head has another alternative type of weighting system.
Figure 14:
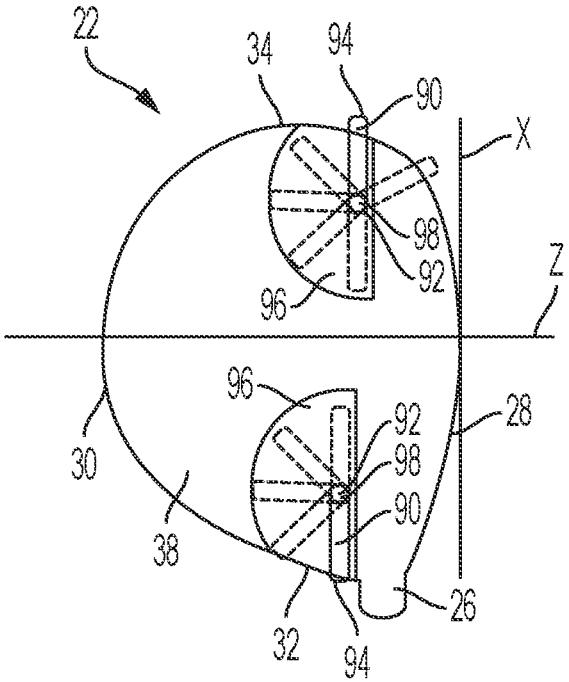
FIG. 14 is a bottom view of a metal wood having an alternative type of weighting system.

FIGS. 13 and 14 show examples of golf club heads 22 with an alternative weighting system that comprises at least one weight 90 that is rotatable from a first angle to at least a second angle. In some cases, the weight 90 may be rotatable through and/or to a plurality of different angles. Such a weight 90 (or "rotatable weight element" or "rotatable weight") 90 may provide rotation by being pivotable (and may, in such cases, be referred to as a "pivoting" or "pivotable" weight element).

FIG. 13 shows the rotatable weight element 90 on an iron club head 22. The rotatable weight element 90 can be of any suitable size and shape. The rotatable weight elements 90 described herein are distinguishable from threaded cylindrical weight elements that are screwed into a club head and unscrewed to remove the same and, thus, need not be cylindrical or threaded. At least a portion of the rotatable weight element 90 can be made of a higher specific gravity material (as described above). There can be any suitable number of rotatable weight elements 90 joined to any portion of the main body of the club head 22.

In this case, there are two rotatable elements—one joined adjacent to the heel 32 of the club head, and one joined adjacent to the toe 34 of the club head. Several non-limiting examples of positions for the rotatable weight elements 90 are shown in dashed lines. These positions include at least one in which at least a portion of the weighting element 90 extends outward beyond the periphery 46 of the club head 22 in the X direction from the heel 32 and/or toe 34. In the embodiment shown, the rotatable elements 90 comprise a rectangular weight that has a proximal end 92 and a distal end 94. The rotatable elements 90 are rotatably joined at a location on the back surface 30 of the club head 22. The back surface 30 of the club head 22 may optionally have a recessed area 96 to make room for rotation of the rotatable weight elements 90. Rotation can be provided by joining the rotatable weight element 90 adjacent its proximal end 92 with a pin 98. The pin 98 can be oriented in any suitable direction. In the embodiment shown, the pin 98 can be oriented generally, or substantially, in the Y direction.

FIG. 14 shows a metal wood club head 22. The metal wood club head 22 can be provided with rotatable weights 90 having the same characteristics described above for the iron club head shown in FIG. 13, In the embodiment shown in FIG. 14, the rotatable element weighting system is provided on the sole 38 of the club head 22. In this embodiment, the sole 38 of the club head 22 may have one or more recessed areas 96. Several non-limiting examples of positions for the rotatable weight elements 90 are shown in dashed lines. These positions include at least one in which at least a portion of the weighting element 90 extends outward beyond the periphery 46 of the club head 22 in the X direction from the heel 32 and/or toe 34. As shown in FIG. 14, the weight elements 90 can rotate forward (toward the club face 28) as well. The surface of the club head 22 to which the rotatable weight elements 90 are attached can also be provided with detents between the positions to keep the rotatable elements 90 from moving once their positions are set. Providing a weighting system that comprises at least one weight element that is rotatable between different angles allows the location of the weight (and the center of gravity of the club head) to be simultaneously adjusted in the X and Z directions.

The weighting systems described herein may have several additional features. The weights can be removable and replaceable with lighter or heavier weights in any of the embodiments described herein. The leading edge of the weights can be aerodynamically shaped, particularly when all or a portion of the weights may extend outward from the periphery of the main body 44. For instance, the leading edge of the weights 54 may be rounded and provided with a convex configuration as shown in FIG. 10, for example. The "leading edge" is the portion of the weights that is furthest forward in the Z direction. The leading edge of any extensions of the track can also be similarly aerodynamically shaped.

In some cases, the weighting systems 50 described herein may not be visible to a golfer when the golf club 20 is held in the usual manner with the club head 22 placed on the ground in the address position. In other cases, one or more portions of the weighting systems 50 may be visible to a golfer when the golf club 20 is held with the club head 22 in the address position.

In addition, any of the weights described herein can be adjustable before play so that the golfer can pre-select a desired shape for the golf shots that they will hit with such clubs and/or to compensate for swing faults that they may have on any given day.

Numerous other embodiments of the golf clubs described herein are possible. For example, in other embodiments, the club head can be provided with more, or fewer, higher specific gravity weights, or weights having different configurations than those shown in each of the drawing figures. In other embodiments, any of the features of the golf clubs described herein can be combined in any suitable manner to produce still other embodiments. The features of the golf clubs described herein may also be combined with the features of the golf clubs described in U.S. Pat. Nos. 5,419,560; 5,540,437; 6,702,693 B2; and 7,815,524 B2, and the references listed on the face and any subsequent pages thereof, as well as in U.S. Patent Application Publication No. 2019/0009143 A1, Myers.

The golf clubs described herein may provide a number of advantages. It should be understood, however, that such advantages are not required to be provided unless specifically set forth in the appended claims. Golfer's swings vary from day-to-day, and shot trajectories (draw or fade; high or low) can vary from club to club. The weighting systems described herein provide a golfer with the ability to adjust any of these things before a round. The weighting system can provide greater adjustability in the moment of inertia than in current club heads having weights that are located in tracks on the underside or the back of the club head that are confined to movement within the periphery of the club head. The weighting system can, in some cases, provide the ability to adjust the center of gravity of the club head upward or downward. This may provide a golfer with the ability to hit a ball lower (for example, when it is windy), or higher (for example, when it is not windy). The weighting system may be adjusted faster than adjustable weighting systems that require removing and screwing in weights.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation.

What is claimed is:

1. An iron golf club head comprising a club face, a back surface on the opposite side of said club head from said club face, a heel portion, a toe portion, a top edge, and a sole extending generally between the heel portion and the toe portion, wherein said golf club head comprises:

a main body having a periphery, wherein said main body is configured to receive a shaft at said heel portion, wherein said main body is perimeter weighted wherein the back surface of said club head comprises a central region which has a cavity therein, wherein the club head has a first thickness measured between said club face and said back surface of said club head, and the cavity is at least partially surrounded by thicker portions on the back surface of said club head; and a weighting system joined to said main body, said weighting system comprising a track and a movable weight, wherein said track forms a channel for said movable weight to slide within the channel and said movable weight is movably joined to said track and is movable between different positions along the track, wherein the track is joined to the back surface of said club head and forms a bridge across the cavity, and the weight is movable along said bridge wherein said weighting system is configured to allow the weight to move between;

a first position that is located inward of the periphery of the main body; and a second position wherein at least a portion of said weight is located outward of the periphery of said main body wherein said second position is at least partially outward in the X-direction beyond the thicker portions on the back surface of said club head.

2. An iron golf club head comprising a club face, a back surface on the opposite side of said club head from said club face, a heel portion, a toe portion, a top edge, and a sole extending generally between the heel portion and the toe portion, wherein said golf club head comprises:

a main body having a periphery, wherein said main body is configured to receive a shaft at said heel portion, wherein said main body has a recess therein; and a weighting system joined to said main body, said weighting system comprising a movable weight, wherein said weighting system is configured to allow the weight to move between:

a first position that is located inward of the periphery of the main body; and a second position wherein at least a portion of said weight is located outward of the periphery of said main body and the movable weight is movable from a retracted position in which the weight is at least partially within said recess, and said weight is movable to an extended position in which at least a portion of the weight protrudes from said recess to place the golf club head in a configuration for use.

3. The golf club head of claim 2 wherein the weighting system further comprises a spring having one portion joined to the main body of the club head and one portion that is joined to the weight that assists the weight in moving from a retracted position to an extended position.

4. A golf club comprising the golf club head of claim 1 further comprising a shaft having a first end and a second end, wherein said first end of said shaft is joined to said golf club head, and the second end of said shaft has a grip thereon.

5. A golf club comprising the golf club head of claim 2 further comprising a shaft having a first end and a second end, wherein said first end of said shaft is joined to said golf club head, and the second end of said shaft has a grip thereon.

* * * * *